US009742050B2

(12) United States Patent
Chong et al.

(10) Patent No.: US 9,742,050 B2
(45) Date of Patent: Aug. 22, 2017

(54) METHODS AND DEVICES FOR GROUNDING DEEP DRAWN RESONATORS

(71) Applicant: Radio Frequency Systems, Inc., Meriden, CT (US)

(72) Inventors: Yin-Shing Chong, Middletown, CT (US); Yunchi Zhang, Wallingford, CT (US); Peter A. Casey, Clinton, CT (US)

(73) Assignee: Alcatel-Lucent Shanghai Bell Co., Ltd., Shanghai (CN)

( * ) Notice: Subject to any disclaimer, the term of this patent is extended or adjusted under 35 U.S.C. 154(b) by 94 days.

(21) Appl. No.: 14/158,535

(22) Filed: Jan. 17, 2014

(65) Prior Publication Data

US 2015/0207194 A1 Jul. 23, 2015

(51) Int. Cl.

| | |
|---|---|
| ***H01P 1/205*** | (2006.01) |
| ***H01P 1/207*** | (2006.01) |
| ***H01P 11/00*** | (2006.01) |
| ***H01P 7/04*** | (2006.01) |
| *H01P 7/10* | (2006.01) |

(52) U.S. Cl.

CPC ..... *H01P 1/2053* (2013.01); *H01P 1/207* (2013.01); *H01P 7/04* (2013.01); *H01P 11/007* (2013.01); *H01P 7/10* (2013.01); *Y10T 29/49117* (2015.01)

(58) Field of Classification Search

CPC ..... H01P 1/207; H01P 11/007; H01P 1/2053; H01P 7/04; H01P 7/10; Y10T 29/49117

USPC ..... 333/211, 222–229, 234, 202, 203, 206

See application file for complete search history.

(56) References Cited

U.S. PATENT DOCUMENTS

| | | | | |
|---|---|---|---|---|
| 2001/0050648 | A1* | 12/2001 | Huang et al. | 343/703 |
| 2003/0231086 | A1* | 12/2003 | Ishikawa et al. | 333/219.1 |
| 2005/0030131 | A1* | 2/2005 | Yamakawa et al. | 333/202 |
| 2011/0241801 | A1* | 10/2011 | Subedi | 333/203 |

* cited by examiner

*Primary Examiner* — Benny Lee
*Assistant Examiner* — Jorge Salazar, Jr.
(74) *Attorney, Agent, or Firm* — The Capitol Patent & Trademark Law Firm, PLLC

(57) ABSTRACT

Difficulties in grounding a non-integral, deep drawn resonator (DDR) to the filter body of a cavity may be substantially eliminated by preventing the movement of the DDR away from a grounding contact area on the filter body. The addition of a compression plate and stop limiter in the connection of the non-integral DR to the filter body helps insure that any such movement is eliminated or substantially reduced.

18 Claims, 4 Drawing Sheets

4'

METHODS AND DEVICES FOR GROUNDING DEEP DRAWN RESONATORS

BACKGROUND

Existing wireless base stations utilize deep drawn resonators (DDR) as a part of an amplification system. In general, there are two types of DDRs; integral and non-integral. In an integral, DDR a resonator and a filter body are formed as one component that makes up a cavity filter. Conversely, in a non-integral DDR the resonator and filter body are separate components making up a cavity filter.

FIG. 1 depicts a simplified view of a cavity filter 4 comprising a non-integral DDR 1. As shown, the non-integral DDR 1 rests on a filter body 2. Typically, the DDR 1 is fixed or otherwise connected to the filter body using a combination of a locked washer 3*a* and screw 3*b*.

Referring now to FIG. 2 there is shown an expanded view of the area where the DDR 1 is connected to the body 2. In particular, FIG. 2 depicts a grounding contact area 2*a* where the DDR 1 is in contact with the body 2 to electrically ground the DDR 1 to the body 2. The typical connection of the DDR 1 to the filter body 2 depicted in FIGS. 1 and 2 presents certain challenges. One challenge is to insure that the DDR 1 remains electrically grounded to the filter body 2 as the temperature of the DDR 1 and body 2 changes (e.g., over a temperature range of −40 degrees Celsius to +90 Celsius). For example, when subject to temperature changes the torque relaxation of the screw 3*b* results in movement of the bottom portion 1*b* of the DDR 1 away from the body 2 (e.g. the screw 3*b* loosens up). As a result the DDR 1 may lose contact with the body 2 across, or at, the grounding contact area 2*a*.

Yet further, the bottom portion 1*b* of the DDR 1 may deflect (e.g., bend) due to the force applied to the bottom portion 1*b* of the DDR 1 by a locked washer 3*a* as the washer 3*a* is forced against the bottom portion 1*b* by the screw 3*b*. The resulting force on the bottom portion 1*b* causes over compression of a portion of the bottom portion 1*b* of the DDR 1 around area 2*b* which, in turn, may cause the DDR 1 lose contact with the body 2 across, or at, contact point 2*a*.

In either case, once the DDR 1 is no longer in contact with the body 2 across, or at, area 2*a* DDR 1 may become "ungrounded" which in turn may cause the frequency transmitted by the cavity filter to "drift" or vary which has adverse effects on the expected operation and performance of the amplification system. It is therefore desirable to provide methods and devices for grounding DDRs that minimizes or substantially eliminates a non-integral DDR from losing contact across, or at, a grounding contact area, which in turn minimizes or substantially eliminates frequency drift.

SUMMARY

Exemplary embodiments of methods and devices for grounding DDRs are provided.

According to an embodiment, a cavity filter may comprise a filter body, a resonator connected to the filter body to ground the resonator, and a compression plate and stop limiter positioned to substantially eliminate movement of the resonator away from a contact area of the filter body. By reducing or eliminating movement of the resonator away from the contact area the resonator remains grounded to the filter body which, in turn, substantially eliminates frequency drift. The resonator may be a DDR in one embodiment of the invention.

The cavity filter may be part of a tower mounted amplifier or antenna.

In embodiments of the invention, the compression plate may comprises a metallic material, such as a non-ferrous, metallic material for example while the stop limiter may be configured as a stepped stopped limiter, or, alternatively, as an embossed concentric ring, stop limiter to name just two examples.

The resonator may operate over a range of frequencies selected from at least 698 MHz to 960 MHz and 1700 MHz to 2700 MHz, for example.

In addition to the inventive cavity filters and other devices, the present invention also provides for related methods. For example, in one embodiment a method may comprise grounding a resonator to a filter body by connecting a filter body and resonator to ground the resonator, and positioning a compression plate and stop limiter to substantially eliminate movement of the resonator away from a contact area of the filter body.

As described above, the cavity filter may be a part of a tower mounted amplifier or antenna, and the so-grounded resonator may comprise a deep drawn resonator that may operate over a range of frequencies selected from at least 698 MHz to 960 MHz and 1700 MHz to 2700 MHz, for example.

Similarly, the compression plate may comprise a metallic material, such as a non-ferrous metallic material. The method may further comprise configuring the stop limiter as a stepped stopped limiter, or, alternatively, as an embossed concentric ring, stop limiter.

Additional features of the inventions will be apparent from the following detailed description and appended drawings.

DETAILED DESCRIPTION, INCLUDING EXAMPLES

Figure 1:
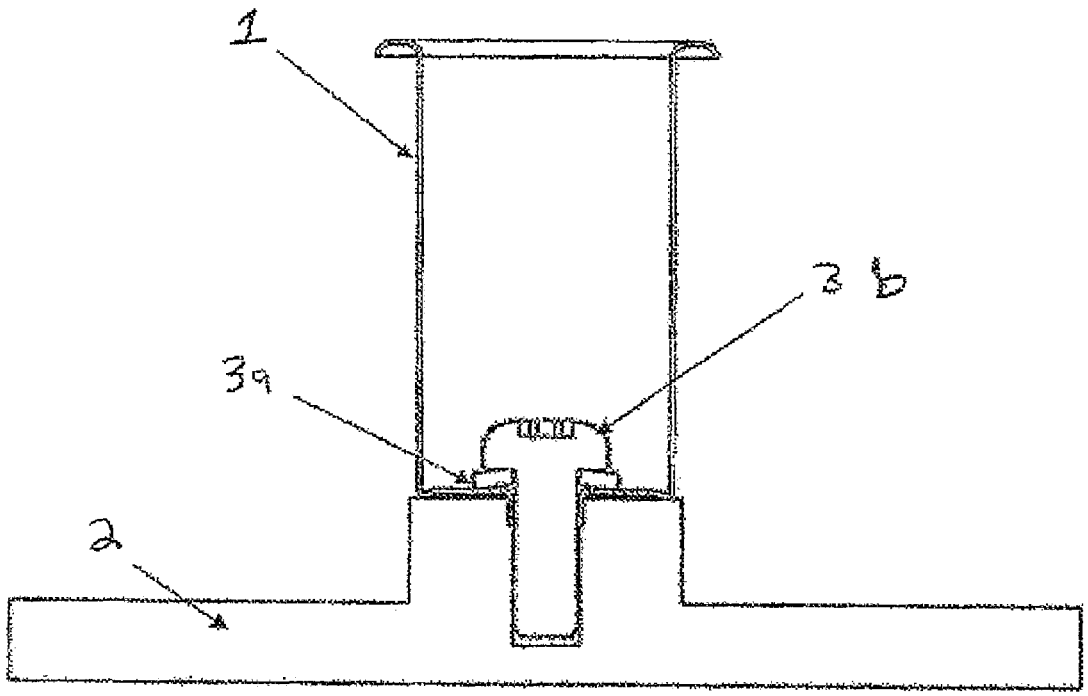
FIGURE 1 PRIOR ART
FIG. 1 of the prior art depicts a cavity filter where a resonator is connected to a filter body using a known locked washer and screw configuration.
Figure 2:
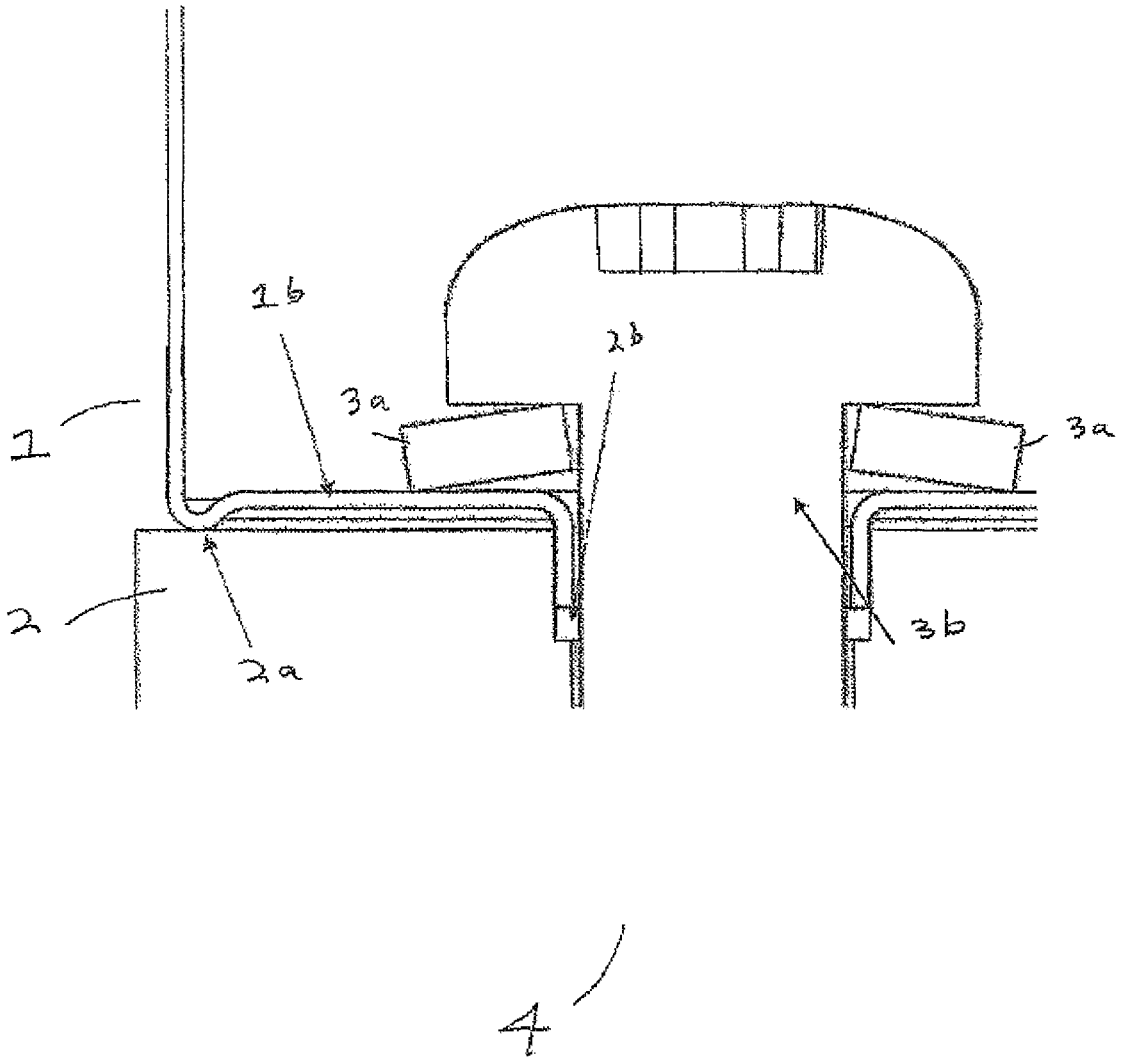
FIGURE 2 PRIOR ART
FIG. 2 of the prior art depicts an expanded view of the filter in FIG. 1 including a grounding contact point.

Exemplary embodiments for grounding DDRs are described herein and are shown by way of example in the drawings. Throughout the following description and drawings, like reference numbers/characters refer to like elements.

It should be understood that, although specific exemplary embodiments are discussed herein there is no intent to limit the scope of present invention to such embodiments. To the contrary, it should be understood that the exemplary embodiments discussed herein are for illustrative purposes, and that modified and alternative embodiments may be implemented without departing from the scope of the present invention. Further, though specific structural and functional details may be disclosed herein, these are merely representative for purposes of describing the exemplary embodiments.

It should be noted that one or more exemplary embodiments may be described as a process or method. Although a process/method may be described as sequential, it should be understood that such a process/method may be performed in parallel, concurrently or simultaneously. In addition, the order of each step within a process/method may be rearranged. A process/method may be terminated when completed, and may also include additional steps not included in a description of the process/method.

As used herein, the term "and/or" includes any and all combinations of one or more of the associated listed items. As used herein, the singular forms "a," "an" and "the" are not intended to include the plural form, unless the context indicates otherwise.

As used herein, the term "embodiment" refers to an embodiment of the present invention.

Figure 3:
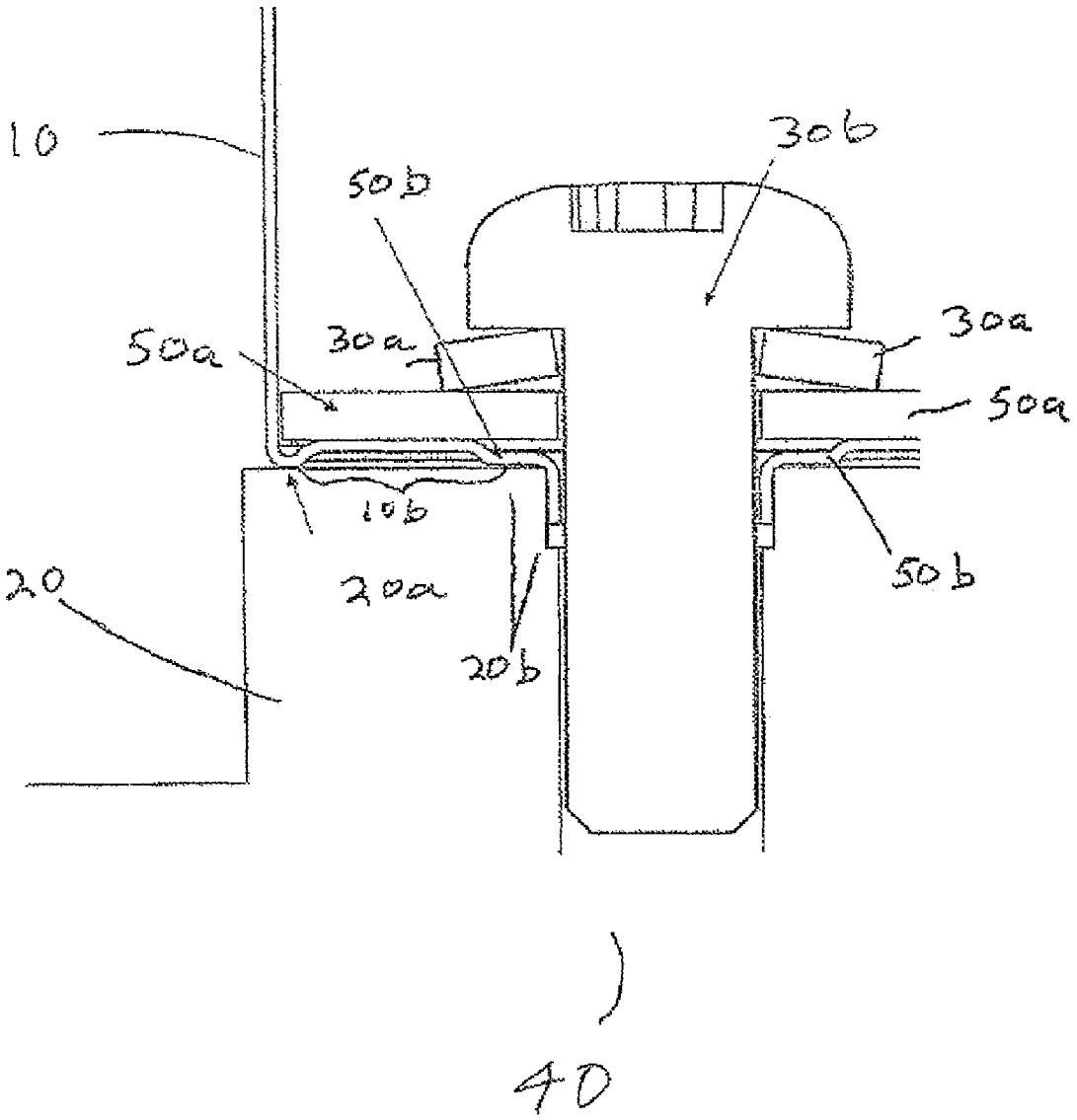
FIG. 3 depicts an expanded view of a cavity filter according to an embodiment of the present invention.
Figure 4:
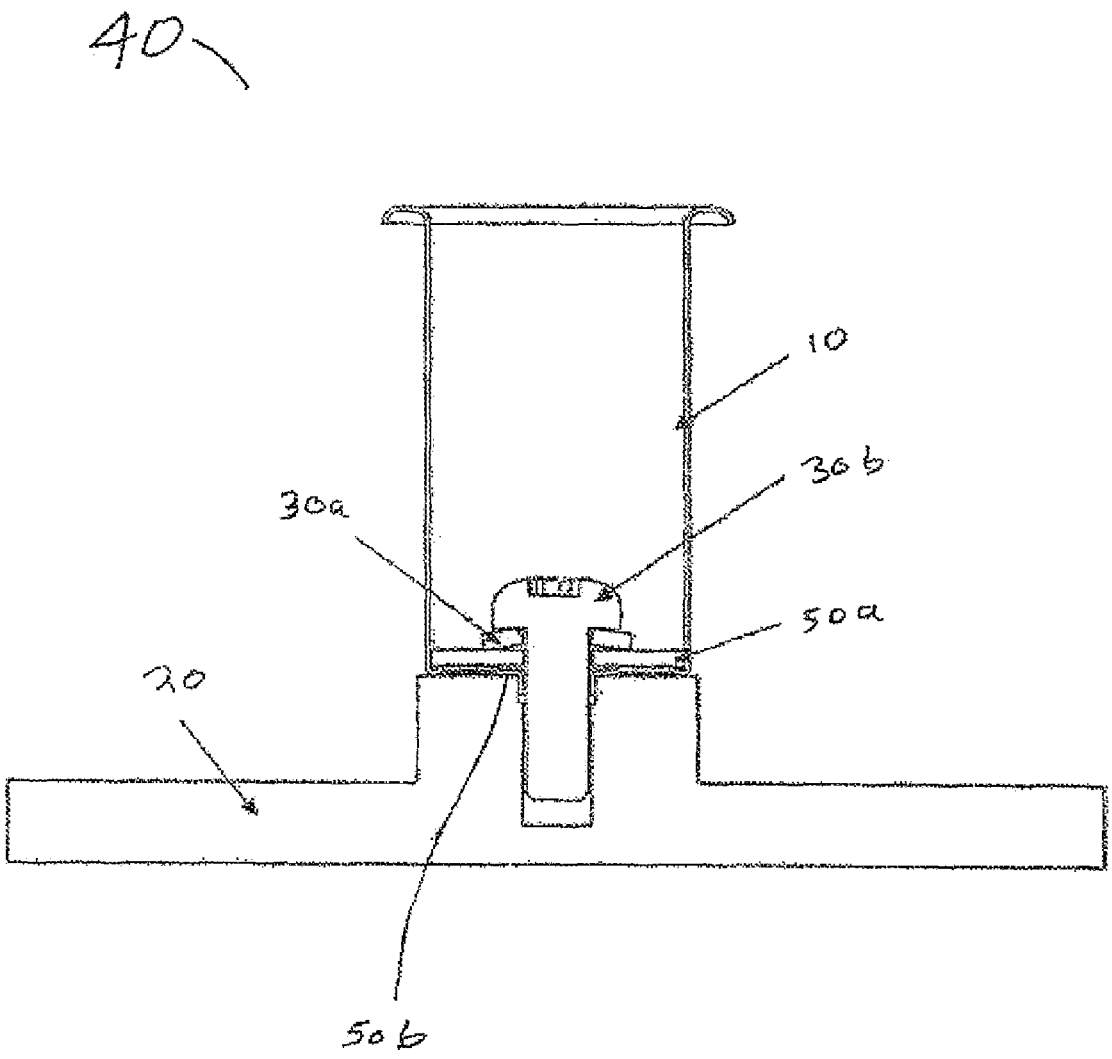
FIG. 4 depicts a cavity filter where a resonator is connected to a filter body according to an embodiment of the present invention.

FIG. 3 depicts an expanded, cross-sectional view of a cavity filter 40 according to an embodiment of the present invention. As shown the cavity filter 40 comprises a DDR 10 and filter body 20 that are connected using locked washer 30*a*, screw 30*b* and deflection reducing means 50*a*, 50*b*. In one embodiment of the invention, means 50*a*, 50*b* may comprise a compression plate 50*a* and a stop limiter 50*b*, respectively, positioned to substantially eliminate movement of the DDR 10 away from a contact area 20*a* of the filter body 20. Though not shown in FIG. 3, it should be understood that the opposite end of the DDR 10 may extend further and be connected to an amplifier or antenna, for example (connection not shown in figures). As shown, the compression plate 50*a* may cover the grounding contact area 20*a*. Further, while only "one" grounding contact area 20*a* appears to be shown in FIGS. 3 and 4, it should be understood that FIGS. 3 and 4 depict cross sectional areas of the components, and, therefore, in three dimensions, the contact area 20*a* area forms a circular contact area, for example, on the bottom surface 10*b* of the DDR 10.

In the embodiment shown in FIG. 3 the combination of the plate 50*a* and limiter 50*b* substantially eliminates deflection of the bottom portion 10*b* which, in turn, substantially eliminates movement of the grounding contact point 20*a*. In more detail, the plate 50*a* functions to distribute the forces, being applied by the screw 30*a* and locked washer 30*b*, more evenly over the surface of the bottom portion 10*b* of DDR 10. This distribution has two effects. First, more of the force applied by the screw 30*b* and washer 30*a* is applied to the bottom portion 10*b* over area 20*a* via portion of plate 40*a* covering the area 20*a*. Second, less of the force is applied to an inner portion of the bottom portion 10*b* over area 20*b*. Both affects help minimize movement (e.g., deflection) of the DDR 1 away from the contact area 20*a*. By reducing or eliminating movement of the DDR 1 away from the contact area 20*a* the resonator 10 remains grounded to the filter body 20, which in turn substantially eliminates frequency drift.

The compression plate may be made of a metallic material, such as a non-ferrous metallic material. Alternatively, the plate may be made from another suitable material. The plate may have a thickness that varies depending on the specific requirements of a particular cavity filter. In one embodiment the thickness may be 1 millimeter.

It should be understood that though component 50*a* is described as a compression "plate" that other equivalent structure(s) may be substituted, provided, such structure functions to distribute some of force being supplied by a screw and washer, such as screw 30*b* and washer 30*a*, over the surface of a bottom portion of a DDR, such as DDR 10. In addition the plate may be substantially flat or may be conical in shape, for example.

Further, though described as a stop limiter 50*b*, other equivalent structure(s) may be substituted, provided, such a structure functions to eliminate or substantially minimize over compression of the bottom portion of a DDR, such as DDR 10, which, in turn, eliminates or substantially minimizes the movement (e.g., deflection) of a DDR away from a grounding contact area. Still further, the "stepped" form of the limiter 50*b* depicted in FIG. 3 (and FIG. 4) is only one of many that may be encompassed by the scope of the present invention. For example, rather than be a stepped shape limiter the limiter may be configured as an embossed concentric ring. Yet still further, while the stop limiter 50*b* is depicted in FIGS. 3 and 4 as being formed from a portion of the bottom surface 10*b* of the DDR 10, it should be understood that the stop limiter may be a separate component inserted at least underneath the inner portion of the bottom portion 10*b* associated with area 20*b*.

FIG. 4 depicts an enlarged, cross-sectional view of the cavity filter 40 depicted in FIG. 3 comprising the resonator 10 and filter body 20. In one embodiment of the invention, the resonator 10 may operate over a range of frequencies, including 698 MHz to 960 MHz, 1700 MHz to 2700 MHz, and other frequency ranges, and may be a part of a tower mounted amplifier, or antenna, such as a low band tower mounted amplifier to name just one of the many types of amplifiers and antennas covered by the present invention.

While exemplary embodiments have been shown and described herein, it should be understood that variations of the disclosed embodiments may be made without departing from the spirit and scope of the claims that follow.

We claim:

1. A cavity filter comprising:

a filter body;

a resonator connected to the filter body and in contact with the filter body at a contact area to ground the resonator, said resonator including a bottom portion having a stop limiter; and a compression plate positioned such that the stop limiter is located between the compression plate and the filter body to substantially eliminate movement of the resonator away from the contact area of the filter body.

2. The cavity filter as in claim 1, wherein the resonator comprises a deep drawn resonator.

3. The cavity filter as in claim 1, wherein the cavity filter is a part of a tower mounted amplifier or antenna.

4. The cavity filter as in claim 1, wherein the compression plate comprises a metallic material.

5. The cavity filter as in claim 1, wherein the compression plate comprises a non-ferrous metallic material.

6. The cavity filter as in claim 1, wherein the resonator operates over a range of frequencies selected from at least 698 MHz to 960 MHz and 1700 MHz to 2700 MHz.

7. The cavity filter as in claim 1, wherein the stop limiter is configured as a stepped stop limiter.

8. A method for grounding a resonator comprising:

connecting a filter body and the resonator so as to place the resonator in contact with the filter body at a contact area, the resonator comprising a bottom portion having a stop limiter to ground the resonator; and positioning a compression plate such that the stop limiter is located between the compression plate and the filter body to substantially eliminate movement of the resonator away from the contact area of the filter body.

9. The method as in claim 8 further comprising configuring the stop limiter as a stepped stop limiter.

10. The method as in claim 8, wherein the resonator comprises a deep drawn resonator.

11. The method as in claim 8, wherein the cavity filter is a part of a tower mounted amplifier or antenna.

12. The method as in claim 8, wherein the compression plate comprises a metallic material.

13. The method as in claim 8, wherein the compression plate comprises a non-ferrous metallic material.

14. The method as in claim 8, further comprising operating the resonator over a range of frequencies selected from at least 698 MHz to 960 MHz and 1700 MHz to 2700 MHz.

15. A cavity filter comprising:

a filter body;

a resonator connected to the filter body and in contact with the filter body at a contact area to ground the resonator, said resonator including a bottom portion having a concentric ring stop limiter; and a compression plate positioned such that the stop limiter is located between the compression plate and the filter body to substantially eliminate movement of the resonator away from the contact area of the filter body.

16. The cavity filter as in claim 15, wherein the resonator comprises a deep drawn resonator.

17. The cavity filter as in claim 15, wherein the cavity filter is a part of a tower mounted amplifier or antenna.

18. The cavity filter as in claim 15, wherein the compression plate comprises a metallic material or a non-ferrous metallic material.

* * * * *